United States Patent [19]

Arnaudeau

[11] 4,265,313

[45] May 5, 1981

[54] MOORING STATION AND TRANSFER TERMINAL FOR OFFSHORE HYDROCARBON PRODUCTION

[75] Inventor: Marcel Arnaudeau, Paris, France

[73] Assignee: Institut Francais du Petrole, Rueil-Malmaison, France

[21] Appl. No.: 11,817

[22] Filed: Feb. 13, 1979

[30] Foreign Application Priority Data

Feb. 14, 1978 [FR] France ..... 78 04330

[51] Int. Cl.[3] ..... E21B 43/017

[52] U.S. Cl. ..... 166/366; 405/169; 166/367

[58] Field of Search ..... 166/358, 359, 366, 367, 166/70; 9/8 P; 405/169

[56] References Cited

U.S. PATENT DOCUMENTS

| | | | |
|---|---|---|---|
| 3,366,173 | 1/1968 | McIntosh | 166/366 X |
| 3,504,741 | 4/1970 | Baker et al. | 166/356 |
| 3,542,125 | 11/1970 | Sizer | 166/366 |
| 3,674,123 | 7/1972 | Lewis et al. | 166/70 X |
| 3,827,486 | 8/1974 | Hall | 166/367 |
| 3,881,549 | 5/1975 | Thomas | 166/366 |

*Primary Examiner*—James A. Leppink
*Assistant Examiner*—Richard E. Favreau
*Attorney, Agent, or Firm*—Millen & White

[57] ABSTRACT

An offshore terminal connected to different underwater producing wellheads which comprises an aerial part provided with a rotatable arm which supports a T F L-servicing pipe and two further pipes including a loading pipe for discharging crude into oil tankers.

This aerial part is supported via an upright riser by a submerged caisson housing manifolds and a T F L-switching barrel.

The riser comprises a plurality of coaxial pipes, which are releasably connected to the top of the caisson by telescopic means, the central conduit of this riser connecting the T F L-servicing pipe to the T F L-switching barrel and the other pipes to different manifolds in the caisson.

13 Claims, 8 Drawing Figures

Figure 1:
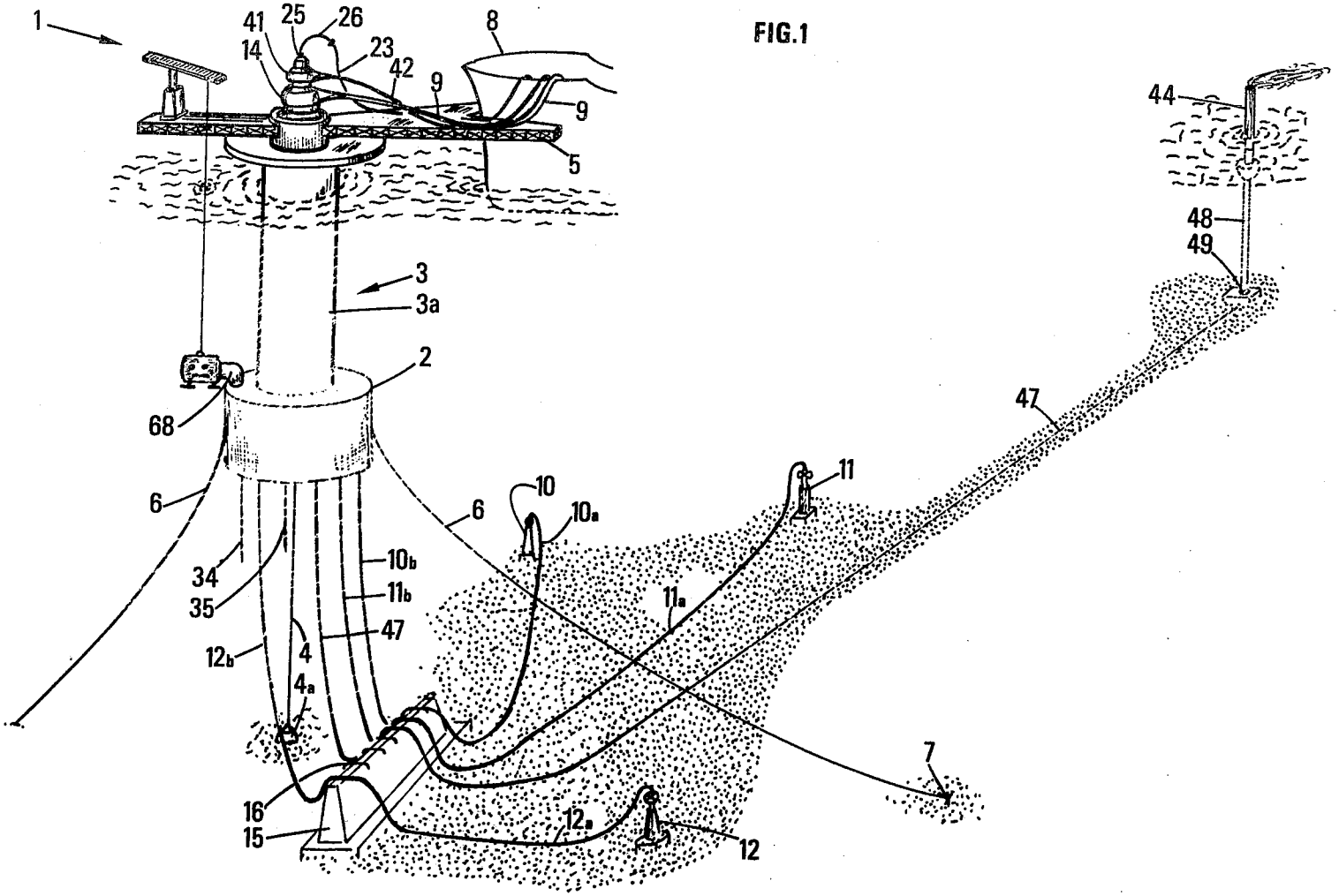

61
26
23
25
41
42
58
18
9
56
59
14
54
55
57

MOORING STATION AND TRANSFER TERMINAL FOR OFFSHORE HYDROCARBON PRODUCTION

BACKGROUND OF THE INVENTION

The present invention relates to a new mooring station and transfer terminal for offshore hydrocarbon production, suitable for mooring oil processing or/and transportation ships.

At the present time offshore hydrocarbon production is developing at locations remote from conventional harbors and this added to the continuous weight increase of oil tankers, leads to building artificial terminals for mooring oil tankers during loading thereof or/and ships for processing the oil-containing effluent from the producing wells.

Known mooring stations and transfer terminals are connected to a plurality of production underwater wellheads, these terminals comprising a caisson surmounted by at least one rotatable arm which supports at least one pipe for loading oil tankers.

In such prior arrangements the different producing wellheads are connected through pipelines to a production manifold lying on the water bottom, this manifold being connected to the caisson through a gathering line lying on the water bottom and a riser connecting this gathering line to the loading pipe supported by the caisson.

OBJECTS OF THE INVENTION

A first object of the invention is to provide a new offshore production system whereby the maintenance operations performed on the production manifold become easier and less expensive.

A second object of the invention is to provide an offshore hydrocarbon production system facilitating servicing operations performed on producing underwater wellheads, more particularly the introduction of tools or instruments into the production tubings by pumping these tools or instruments in counterflow through the production tubings, down to the bottom of a selected producing well. This pumping process is the well known TFL (Through Flow Line) method.

A main object of the present invention is to provide an offshore hydrocarbon production system which, while complying with the above requirements, is suitable at important water depths.

SUMMARY OF THE INVENTION

These objects are achieved according to the invention with a new mooring station and transfer terminal for offshore hydrocarbon production from a plurality of underwater wells connected to underwater manifolds, comprising an aerial part, a riser consisting essentially of a plurality of pipes including at least one production pipe, said pipes connecting said manifolds to said aerial part, and a through-flow-line (T.F.L.) servicing pipe connecting said aerial part to underwater switching means connected to the different producing wells, said switching means enabling said T.F.L.-servicing pipe to be selectively connected to any one of the wells, wherein said pipes in said riser are coaxially arranged around said T.F.L.-servicing pipe and wherein the lower part of said riser is adapted to be connected to an underwater connector comprising a plurality of coaxial conduits cooperating respectively with said coaxial pipes of the riser said conduits comprising a central conduit connected to said switching means and surrounding annular conduits connected to the different underwater manifolds.

DETAILED DISCUSSION

The manifolds and the switching means will advantageously be housed in a watertight caisson.

They may rest on the water bottom, but according to an embodiment which is more specically described hereinunder the manifolds and the switching means are housed in a caisson of positive buoyancy which is held submerged at a depth sufficient to preserve it from the action of swell, the producing wells being connected through flexible pipes to the manifolds and the switching means located in the caisson.

Figure 1A:
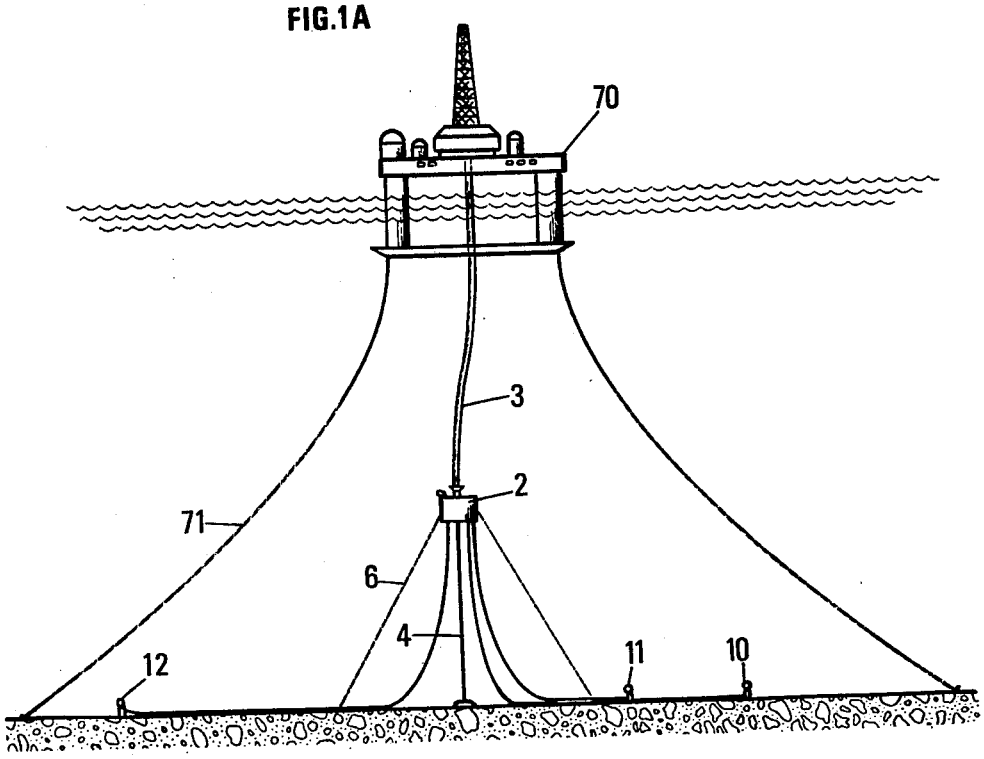
Figure 1B:
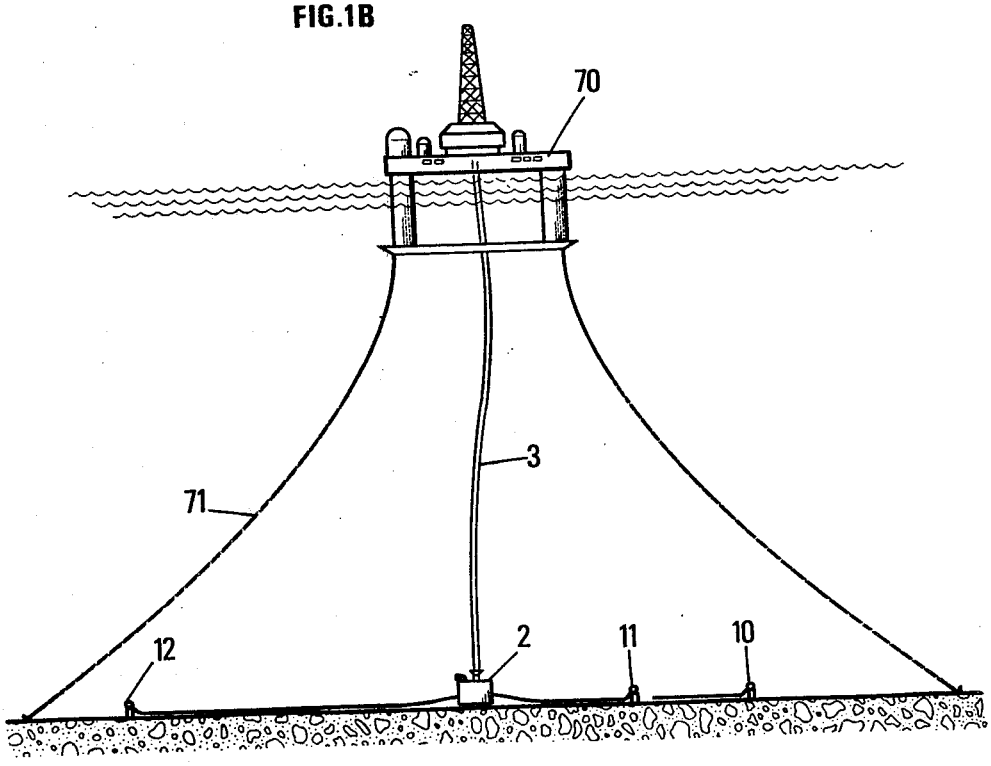
Figure 2:
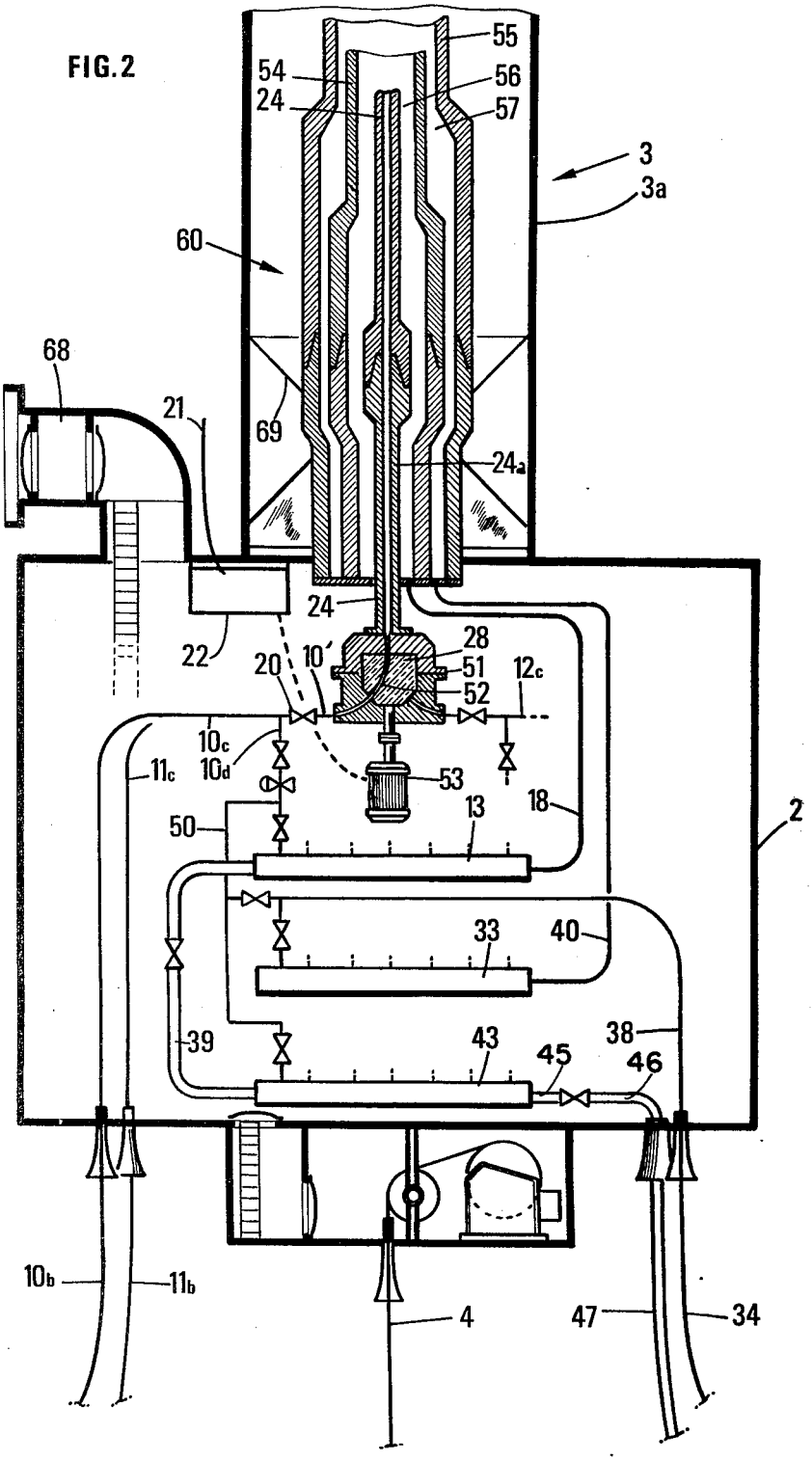
Figure 3A:
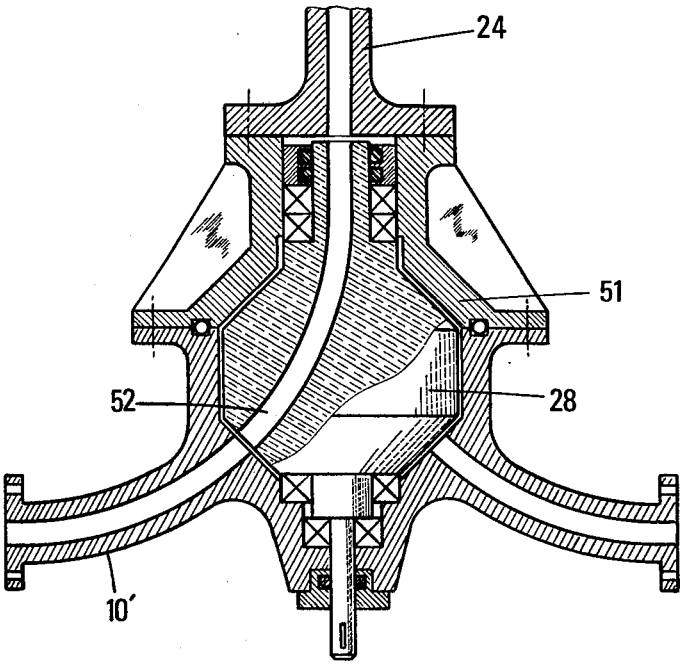
Figure 3:
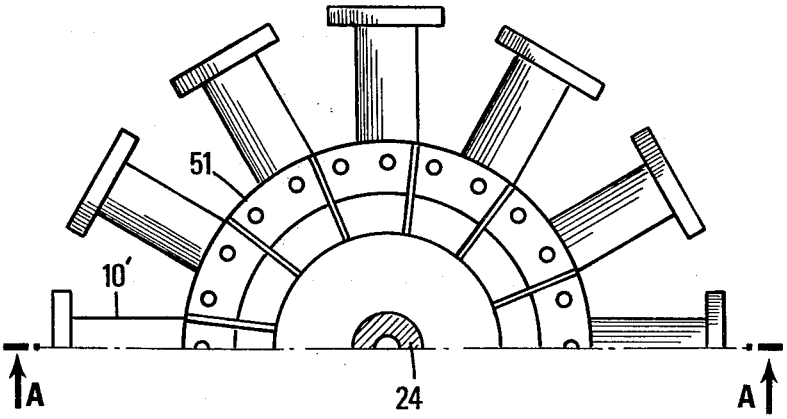
Figure 4:
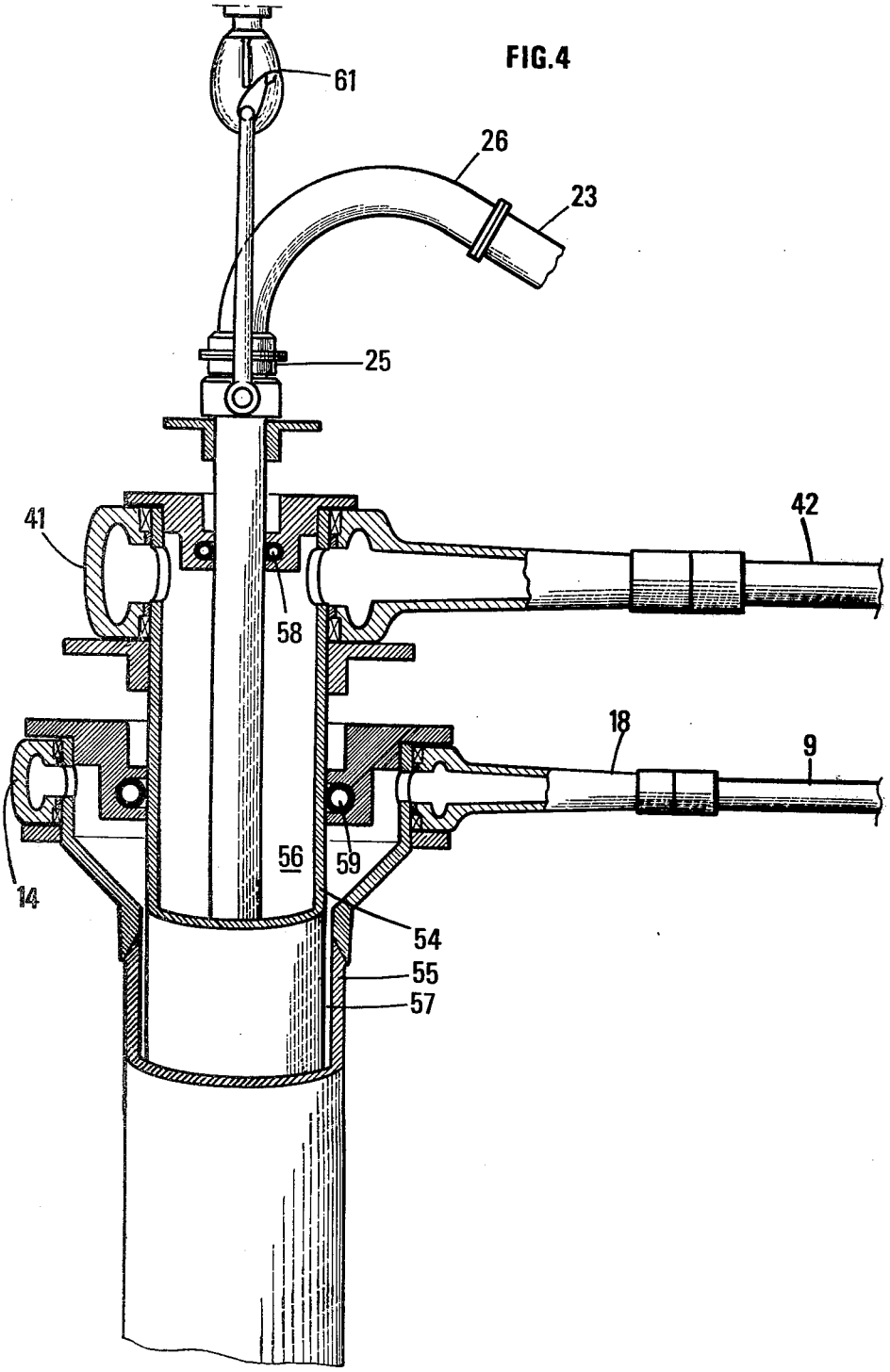
Figure 5:
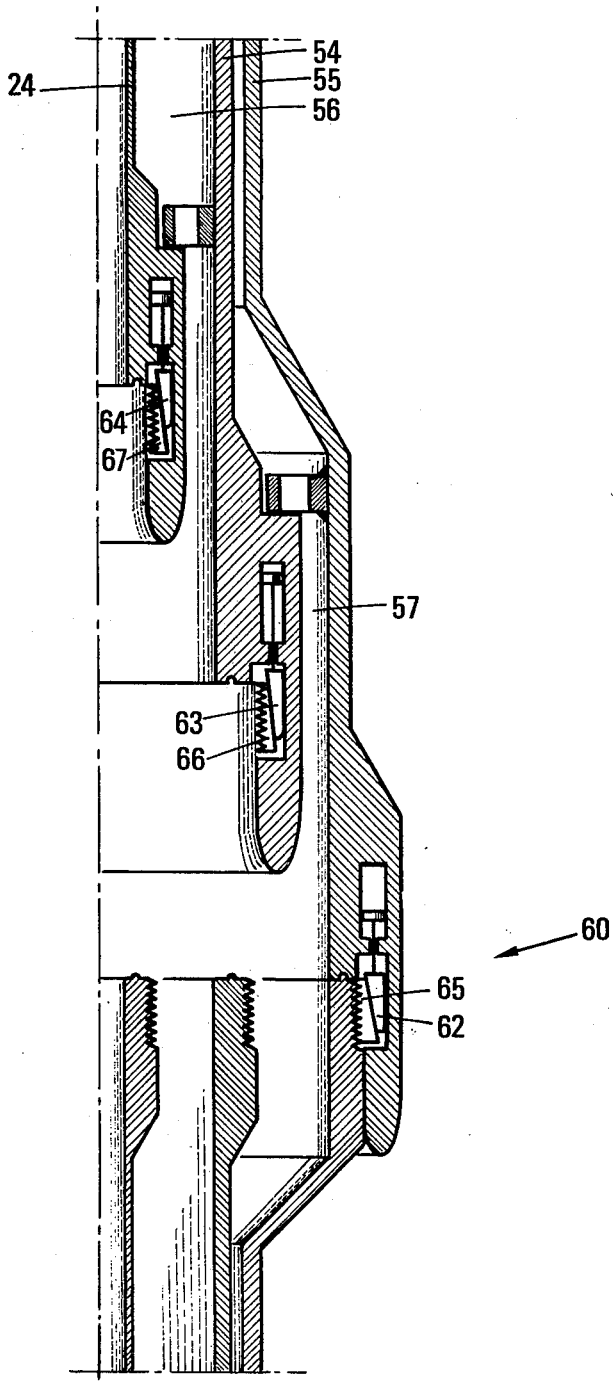

THE INVENTION IS ILLUSTRATED BY THE ACCOMPANYING DRAWINGS, WHEREIN:

FIG. 1 is an overall view of a first embodiment of a mooring station and transfer terminal according to the invention, FIGS. 1A and 1B illustrate two other embodiments, FIG. 2 diagrammatically shows the caisson and the lower part of the telescopic column, in axial section, FIG. 3 is a half-view from above of an embodiment of the T.F.L. tools switching barrel, FIG. 3A shows the same barrel in axial section, FIG. 4 and 5 illustrate the step of connecting the telescopic column to the underwater caisson.

In FIG. 1, reference 1 designates, as a whole, a mooring station and transfer terminal according to the invention, comprising a watertight caisson 2 which supports a rotatable arm 5 via a riser 3 formed of a thick-walled tube 3A and of a telescopic assembly of three coaxial pipes. The watertight caisson 2 has a positive buyancy and is held submerged by one or more vertical mooring lines 4 (cables, chains . . . ) secured to the water bottom by mooring masses 4*a*. The mooring terminal 1 is held in position by anchoring means comprising mooring lines 6 and anchors 7.

Mooring lines 6 may either be secured to caisson 2, as illustrated, or to an annular element located just under rotatable arm 5.

The rotatable arm 5 permits mooring of an oil tanker 8 and loading of this tanker through or more loading pipes carried by arm 5 and which are connected through any suitable means to the tanks of ship 8.

Arm 5 may or may not be U- or V- shaped, as illustrated in FIG. 1, to facilitate mooring of the prow of ship 8.

The different producing wellheads, such as 10, 11 and 12 are connected through flexible flowlines 10*a*, 11*a*, 12*a* and risers 10*b*, 11*b*, 12*b* to a production manifold 13 (FIG. 2) housed in caisson 2, this production manifold being connected to the flexible loading pipe 9 through a rotary coupling 14 at the upper part of riser 3.

In the embodiment illustrated by FIG. 1, the flexible flowlines 10*a* and 10*b* are locally supported, in the vicinity of the water bottom, by guide means comprising, for example, a support member 15 provided with guide elements 16 having rounded rims to limit bending stresses in the supported flexible pipes at their location.

As shown in FIG. 2, the production manifold 13 located in caisson 2, is connected to the different underwater production wellheads through risers 10*b*, 11*b* and 12*b*. These risers permit flowing of the production and injection or counterflow pumping of T.F.L. tools or instruments.

The production manifold 13 is connected to flexible loading pipe 9 through rotary coupling 14 and conduit 18.

Connection of a flexible production riser such as riser 10*b* to manifold 13 is achieved through conduits or rigid tubular connectors as 10*c* and 10*d*.

The radius of curvature of conduits such as 10*c* and that of the rim of guiding elements 16 which are located in the vicinity of the water bottom, will be selected sufficient to avoid jamming of special T.F.L. tools or instruments (for example scraping tools, measuring instruments . . . ) in the tubular connectors or in pipes such as 10*b*, 11*b*, 12*b* and 10*a*, 11*a*, 12*a*.

Tubular connectors such as 10*c* are provided with valves 20 which are normally closed when the wells are producing and can be remotely actuated from the water surface together with the other valves of the installation, through a line 21 for remote control and power transmission carried by rotatable arm 5 and connected to a main station 22 wherefrom the valve assembly can be remotely controlled. The connection between this main station 22 and the valves has not been shown in FIG. 2 for sake of clarity of the drawing.

Without interrupting the production of the other wells whose T.F.L. valves 20 remain closed, it is possible to introduce into one of the wells, from the water surface, a tool or instruments according to the T.F.L. process through a T.F.L. servicing pipe designated by reference 23 in the drawings; the valve 20 corresponding to the selected well being opened.

This flexible pipe 23 is connected to a central pipe 24 of column 3 through a rotary coupling 25 and a connecting pipe 26 whose radius of curvature is sufficient to prevent jamming of T.F.L. tools or instruments.

Insertion of these tools or instruments into one of pipes 10*c*, 11*c*, or 12*c*, . . . corresponding to the well wherein a servicing operation is to be carried out, is achieved through switching means connecting this pipe to a conduit 24*a* connected to the lower part of axial pipe 24.

In the embodiment illustrated in FIGS. 2, 3 and 3A the switching means in the caisson consists of a drum or barrel 28 rotatably mounted in a housing 51. The T.F.L.-servicing pipe 24 communicates with this housing on the axis thereof. The barrel is provided wih an internal curved conduit 52 which forms an extension of T.F.L. conduit 24–24*a* and can be connected by rotating barrel 28 to only one of the pipes of a piping system, such as pipe 10′ communicating with 51 through apertures located about the axis thereof, such pipes being connected to the different wells through flexible pipes such as production and T.F.L.-servicing pipes 10*a*, 10*b* (FIG. 1) and through connecting conduits such as 10*c* and they are also connected through conduits such as 10*d* to production manifold 13. Barrel 28 is provided with positioning means which can be remotely controlled.

Such positioning means comprises a motor 53 which can be connected to the central control station 22.

By remotely controlling the rotation of barrel 28 from the water surface through line 21, it is thus possible to connect pipe 24 to anyone of the vertical conduits 10*c*, 11*c* or 12*c* i.e. to select the well wherein a T.F.L.-servicing operation is to be performed.

Caisson 2 also houses a second manifold 33 providing for the safety of the oil field and of the installation by permitting fluid injection into the wells from the water surface. This manifold 33 is connected to the different wellheads through flexible pipes such as 34, 35 and conduits such as conduit 38. Flexible pipes such as 34, 35 have two main purposes which are well known in the art: first they are used as fluid circulation pipes during T.F.L. operations and in addition they are used as safety pipes for controlling the pressure in the annular space of the producing well. Connection of flexible pipes 34, 35 to the different wellheads 10, 11 respectively is not shown in FIG. 1 for sake of clarity.

Manifold 33 is connected through a conduit 40 and a rotary coupling 41 to a safety flexible pipe 42 carried by the rotatable arm 5 (together with loading pipe 9 and T.F.L. circulation pipe 23), to permit injection of safety fluid from the water surface.

Caisson 2 houses a third manifold 43 through which some of the above mentioned conduits can be connected to a flare 44 (FIG. 1), the connection of these conduits to manifold 43 being for example achieved as diagrammatically illustrated in FIG. 2.

Connection of manifold 43 to flare 44 is achieved through conduits 45 and 46 and flexible pipes 47 and 48, the later being anchored to the heavy mass 49.

Production manifold 13 is connected to flare manifold 43 through conduits such as 39.

Similarly each well is separately connected to the flare manifold 43 through a pipe 50.

For safety reasons two assemblies of conduits and flexible pipes connecting to the flare are preferably used (only one 45, has been illustrated in the drawings) each of these assemblies being of sufficient diameter to convey by itself, whenever needed, the production of all the wells.

Thus, each of the wells is at the same time separately connected to the production manifold 13, the T.F.L. circulation, the well annular space safety manifold 33 and the flare manifold 43. The interconnecting pipes are of course provided with manually operated or remotely controlled switch valves such as those diagrammatically shown in FIG. 2 for well 10, the other wells 11, 12 . . . etc . . . being controlled in analogous manner to manifolds 13, 33 and 43.

The three conduits of the telescopic tubular assembly first include the central pipe 24 which is connected at its upper part to T.F.L.-servicing pipe 23 (FIG. 4). The two other pipes 54 and 55 (FIG. 4) define two annular spaces 56 and 57 respectively limited at their upper part by sliding sealing means 58 and 59 and respectively carrying the rotary coupling 14 with loading pipe 9 and the rotary coupling 41 with circulation and safety conduit 42.

At its lower part (FIG. 2), the telescopic riser 3 is connected to caisson 2 by a connector 60 through which central pipe 24 communicates with the curved conduit 52 of barrel 28 of the switching means and annular spaces 56 and 57 are respectively connected to production manifold 13 and to circulation and safety manifold 33 through conduits 18 and 40 respectively.

The three coaxial pipes 24, 54 and 55 may be formed by rigid or flexible conduits.

In a mooring station and transfer terminal according to the invention, where the watertight caisson 2 is submerged at a substantial depth, the telescopic riser facilitates connecting and disconnecting operations.

As shown in FIGS. 4 and 5, connection of the three pipes 24, 54 and 55 to caisson 2 is effected successively by means of a lifting hook or travelling block 61 sup ported from a surface installation (ship, platform . . . ) through a heave compensator which may be of a known type. Connector 60 is lowered by sliding within tube 3*a*. Its accurate positioning may be achieved through a funnel-shaped guiding device 69 at the lower end of tube 3*a*.

External pipe 55 is first connected to caisson 2 and the two other pipes 54 and 24 are thereafter successively lowered by hook 61, as illustrated in FIG. 4 which shows the lowering of the central pipe 24. The second pipe 54 and thereafter the third pipe 24 (FIG. 5) are then connected to caisson 2.

These connections do not require any accurate preliminary orientation of each of pipes 24 and 54 relative to caisson 2, owing to the selected telescopic arrangement.

Connector 60 will for example be provided with remotely controlled hydraulic locking means 62, 63 and 64, adapted to permit quick releasing of the three pipes 24, 54 and 55 at the same time, by a simple pull after releasing of the hydraulic pressure in the locking circuits, so that the locking wedges 65, 66 and 67 (FIG. 5) can be moved apart from one another under the action of (not shown) resilient return means.

In the different above-described embodiments, access means 68 to the caisson (either direct or through a lock) will be provided for the personnel in charge of the maintenance of the manifolds and of the associated equipments.

Safety venting means will be provided for the caisson.

FIGS. 1A and 1B illustrate embodiments of the invention which can be used at great water depths.

In these two embodiments, riser 3 is supported at its upper part by a production platform 70 held in position by any suitable means, such as mooring lines 71.

In the embodiment illustrated in FIG. 1A, the caisson 2 is also of positive buoyancy and kept submerged as in the embodiment of FIG. 1.

In the embodiment of FIG. 1B this casisson rests on the water bottom. It may optionally be replaced by a simple support structure for manifolds 13, 33 and 43, barrel 28 and for the means connecting these elements to the coaxial conduits of riser 3, if these elements are not to be housed in a watertight container.

In another embodiment, the flexible riser 3 of FIGS. 1A and 3A will be housed in a rigid protecting tube, such as the 1B of FIGS. 1 and 2, this tube being connected to platform 70 by a suitable rigid connecting structure and being releasably connected to caisson 2 at the level of connector 60 of flexible riser 3.

The system can thus be operated with the rigid tube 3*a* disconnected from caisson 2, particularly at shallow depths of the latter, the caisson being then connected to platform 70 only by flexible riser 3. Alternatively the system can be operated with the rigid tube 3*a* connected to caisson 2, especially when this caisson is immersed at a great depth.

In the latter case, when platform 70 is subjected to vertical alternating pounding movements with respect to caisson 2, the flexible riser 3 will not be subjected to excessive stresses, since the pounding movements of platform 70 are then transmitted to the flexible lines such as 71 located at the lower part of the system, through the rigid assembly constituted by the rigid structure connecting the protecting tube 3*a* to platform 70, by the rigid tube 3*a* itself and by the caisson 2 to which this tube is connected.

What I claim is:

1. A mooring station and transfer terminal for offshore hydrocarbon production from a plurality of underwater wells connected to a plurality of production lines, each line communicating with one of said wells, said mooring station and transfer terminal comprising:

at least one underwater production manifold communicating with said production lines;

a riser comprising a through-flow line (TFL) servicing pipe and a plurality of pipes coaxial with and enclosing said TFL servicing pipe and defining annular spaces therebetween, said coaxial pipes including at least one production pipe communicating with said production manifold;

underwater switching means comprising a movable pipe communicating at one end with said TFL servicing pipe, a plurality of ports each of which communicates with a different one of said plurality of production lines, and means for selectively bringing the other end of said movable pipe into communication with any selected one of said plurality of ports; and a surface facility comprising means for introducing tools into said TFL servicing pipe and communicating with the upper end thereof, and means for receiving the outflow of said at least one production pipe and communicating with the upper end thereof.

2. A mooring station and transfer terminal according to claim 1, which further comprises a flare manifold communicating with said plurality of production lines, and a flare communicating with said flare manifold.

3. A mooring station and transfer terminal according to claim 1, wherein said riser is flexible and said surface facility is a floating structure.

4. A mooring station and transfer terminal according to claim 3, which further comprises a submerged watertight caisson within which said switching means and said at least one production manifold are housed, and a rigid protecting pipe supported by said floating structure within which said flexible riser is housed, the lower end of said rigid pipe being adapted to be releasably connected to said caisson.

5. A mooring station and transfer terminal according to claim 1, which further comprises an underwater connector comprising a plurality of coaxial conduits, said conduits comprising a central conduit communicating at its lower end with the upper end of said movable pipe, and surrounding annular conduits including at least one conduit communicating at its lower end with said production manifold; and wherein the lower end of said riser is adapted to releasably connect with the upper end of said connector, the coaxial pipes of said riser cooperating with the coaxial conduits of said connector, said TFL-servicing pipe cooperating with said central conduit.

6. A mooring station and transfer terminal according to claim 5 wherein said riser comprises coaxial telescopic means for connecting said riser to said underwater connector.

7. A mooring station and transfer terminal according to claim 5, which further comrises at least one underwater circulation and safety manifold communicating with said plurality of production lines; wherein said plurality of coaxial pipes in said riser further includes at least one circulation and safety pipe communicating at its lower end with said circulation and safety manifold and at its upper end with said surface facility; and wherein said surface facility further comprises means for connecting said circulation and safety pipe to a source of safety fluid.

8. A mooring station and transfer terminal according to claim 7, wherein said riser comprises a telescopic column formed of at least three coaxial pipes, comprising said central TFL-servicing pipe, said at least one coaxial production pipe and said at least one coaxial circulation and safety pipe, and wherein the annular spaces defined by said coaxial pipes are limited at their upper ends by sliding sealing means.

9. A mooring station and transfer terminal according to claim 5, which further comprises a submerged watertight caisson within which said switching means and said at least one production manifold are housed, said underwater connector being secured to the upper part of said caisson.

10. A mooring station and transfer terminal according to claim 9, wherein said caisson has a positive buoyancy and does not rest on the water bottom.

11. A mooring station and transfer terminal according to claim 9, which further comprises a watertight tubular column secured to the top of said caisson within which said connector at the upper part of the caisson is housed.

12. A mooring station and transfer terminal according to claim 9, which further comprises quickly releasable connecting means for connecting said telescopic means to said caisson.

13. A mooring station and transfer terminal according to claim 9, comprising access means for maintenance personnel into said caisson.

* * * * *